US006584622B1

(12) United States Patent
Nilsson

(10) Patent No.: US 6,584,622 B1
(45) Date of Patent: Jul. 1, 2003

(54) METHOD AND DEVICE FOR TIMER-CONTROLLED FLUSHING OF WATER TOILETS

(75) Inventor: Hans Nilsson, Västervik (SE)

(73) Assignee: Ninotech HB (SE)

( * ) Notice: Subject to any disclaimer, the term of this patent is extended or adjusted under 35 U.S.C. 154(b) by 0 days.

(21) Appl. No.: 09/763,264

(22) PCT Filed: Aug. 13, 1999

(86) PCT No.: PCT/SE99/01369

§ 371 (c)(1),
(2), (4) Date: May 30, 2001

(87) PCT Pub. No.: WO00/12829

PCT Pub. Date: Mar. 9, 2000

(30) Foreign Application Priority Data

Aug. 26, 1998 (SE) ..... 9802835

(51) Int. Cl.[7] ..... E03D 1/14
(52) U.S. Cl. ..... 4/324; 4/361; 4/381; 4/407
(58) Field of Search ..... 4/324, 325, 378, 4/375, 381, 412

(56) References Cited

U.S. PATENT DOCUMENTS

| | | | | |
|---|---|---|---|---|
| 4,392,260 A | | 7/1983 | Bensen | 4/324 |
| 4,651,359 A | | 3/1987 | Battle | 4/324 |
| 4,748,699 A | * | 6/1988 | Stevens | 4/324 |
| 5,265,282 A | * | 11/1993 | Schmucki | 4/325 |
| 5,305,474 A | * | 4/1994 | Nardi et al. | 4/324 |
| 5,555,573 A | | 9/1996 | Jensen | 4/325 |
| 5,720,053 A | * | 2/1998 | Menge | 4/325 |
| 5,819,330 A | | 10/1998 | Yokel | 4/325 |

FOREIGN PATENT DOCUMENTS

| | | |
|---|---|---|
| FR | 2712320 | 5/1995 |
| SE | 131217 | 3/1951 |
| SE | 366 085 | 4/1974 |
| SE | 367 226 | 5/1974 |
| SE | 7706418-6 | 1/1979 |
| SE | 501 336 C2 | 1/1995 |
| SE | 508 084 C2 | 8/1998 |

* cited by examiner

*Primary Examiner*—Gregory L. Huson
*Assistant Examiner*—Huyen Le
(74) *Attorney, Agent, or Firm*—Lerner, David, Littenberg, Krumholz & Mentlik, LLP

(57) ABSTRACT

Methods and apparatus for flushing a toilet are disclosed, the method including actuating a flushing initiator to open a reservoir discharge valve, closing the reservoir discharge valve after a predetermined period of time, and determining that predetermined period of time by means of a hydraulic timer disposed in a water-containing reservoir whereby the water remaining in the water-containing reservoir operating the hydraulic timer. Apparatus for carrying out these methods are also disclosed.

19 Claims, 4 Drawing Sheets

METHOD AND DEVICE FOR TIMER-CONTROLLED FLUSHING OF WATER TOILETS

FIELD OF THE INVENTION

The present invention relates to a method and apparatus for flushing water toilets that can be flushed with one or more selectable, adjustable amount(-s) of water. More particularly, the present invention relates to flushing devices of the kind allowing fitting during production of new toilets as well as retrofitting in existing water toilets in the form of a complete cartridge, replacing the existing flushing float/valve device, the latter commonly being of the type allowing only one flushing water amount, i.e. a substantially complete draining of the flushing reservoir.

BACKGROUND OF THE INVENTION

Most known flushing devices for water toilets have been based on a method of flushing utilising either manual or level-controlled flushing, i.e. the flushing valve was either kept open manually and was closed upon releasing the operating device, or was actuated manually and was closed upon reaching a predetermined water level in the flushing reservoir.

Ever since flushable water toilets were introduced, there has been a constant development towards managing the flushing function with ever-smaller amounts of water. Initially, the motive was to save water and reduce the volume of the flushing reservoir. An increasing environmental awareness has accentuated the need for such developments, and more recently with the added motive of decreasing the emissions to wastewater purification plants.

It has been known for some time to equip flushable water toilets with devices for flushing them with at least two selectable water amounts, a smaller one, here called "economy flushing", which may be used in connection with urination only, and a full-sized one, here called "full flushing", for other needs. One example of this is described in the Swedish Patent No 131,217.

A large number of the known designs of this type are only suitable when used in connection with the initial manufacture of water toilets. This, for example, applies to the device described in Swedish Patent No 366,085, which shows a flushable water toilet having a new type of flushing valve with modified flow conditions, and to Swedish Patent No 501,336, describing a novel valve device where the same control handle allows selection of economy flushing by pushing the handle down and full flushing by lifting it upwards.

A commonly used design for such economy flushing devices, where the same type of float-action discharge valve is used as is the case for normal flushing toilets, is based upon an additional weight with an associated float, which is connected to the discharge valve during economy flushing, thereby closing it earlier, but which is disconnected from the discharge valve during full flushing, so that the valve operates in the normal manner. Swedish Patent No 367,226 discloses a device for achieving this function. In this case, two concentric handles are used, the lower/outer one for economy flushing and the upper/inner one for full flushing. The additional weight for the economy flushing is located in the lower handle itself, which furthermore has the disadvantage of making economy flushing heavy to execute, for example for children and persons having reduced hand power capacity, e.g. rheumatics. The normal reflex is to lift the upper handle as usual which, together with the above-mentioned additional weight of the handle, will result in full flushing being performed more often than necessary, instead of economy flushing.

Swedish Published Application No 7706418-6 describes a design having a weight and float of the above type, which is said to allow mounting in conventional flushing devices.

U.S. Pat. No. 4,651,359, British Patent No. 2,300,006 and French Patent No. 2,712,320 also describe various level controlled flushing devices with one or more adjustable fluid levels in the flushing reservoir in which the hitching-up of the discharge valve is released and the flushing valve thus closes. The same applies to Swedish Patent No 508,084, assigned to the assignee of the present application.

It is also known on the one hand to flush by means of pushing a button instead of pulling it, and on the other to operate/select two different amounts of flushing water by pushing at two different locations, i.e. on one end or the other of a toggle switch or on two separate buttons located substantially adjacent to each other.

By the cited art for closing the discharge valve of the flushing reservoir at different remaining levels in the reservoir, corresponding to different amounts of water being discharged, i.e. a smaller one for economy flushing and a larger one, usually entailing a complete discharge of the contents of the flushing reservoir, for a full flushing, closing of said discharge valve of the flushing reservoir is based on the water level in the actual flushing reservoir being sensed by a float. This means, when retrofitting an economy-flushing valve function exhibiting two different flushing water amounts, that the retrofitted device must allow adaptation of its mechanical float position to different levels in the flushing reservoir in order to e.g. discharge half of the water volume. See, for example, Swedish Patent No 508,084, assigned to the assignee of the present application. As is known, modern designs have resulted in numerous different shapes of flushing reservoirs being present on the market, causing a flushing device of this kind allowing retrofitting to become relatively complicated, and thereby costly, to produce. This is the case because it must allow for mechanical adaptation regarding its fixation in reservoirs of varying heights, as well as float level adaptation for closing the discharge valve at a water level, in reservoirs of different geometric shapes, which correspond to an appropriate amount of water having been discharged for an economy flushing.

U.S. Pat. No. 4,392,260 describes a device for the flushing of water toilets, having two pre-set, adjustable amounts of flushing water. The discharged amount is determined by an electrical timer device, exhibiting a predetermined, adjustable period of time between that point in time when an operating device for flushing is actuated, and the point in time when the discharge valve of the flushing reservoir, which was opened by the operating device, is closed again. This flushing device thus operates like an electrical, adjustable timer, by which two triggering delay time periods for the closing of the discharge or flushing valve of the reservoir (for economy and full flushing, respectively) can be individually pre-set.

U.S. Pat. No. 5,819,330 describes a similar flushing device, in which the timer device for determining how long time the flushing valve will be open consists of a mechanical timer device, like the works of a watch or an egg timer, having a short running time.

These last two patents thus indicate a different method of flushing, that is to base the closing of the flushing valve on a period of time, by means of a timer device, instead of on a sensed remaining water level in the flushing reservoir.

Even if these timer devices have functioned to some satisfaction, they still have certain disadvantages. Fitting electrical equipment into water toilets, where the environment is very wet and corrosive requires, in order to achieve a long service life, high reliability and personal safety, extensive encapsulation, protective grounding, etc., which will increase the product cost substantially. Fitting mechanical devices like the works of a clock into this wet and corrosive environment requires, except for the electrical insulation, about the same encapsulation in order to achieve reliability during a long period of time. This will likewise increase the cost and complexity of the product.

Several of the known economy flushing devices also have the drawback of requiring careful adaptation to the replenished water level of the reservoir, in order to provide with certainty the intended function/water amount when operated, especially for economy flushing. As the water level will often change with time, for various wear, corrosion and pollution reasons, a secure function of several of the known devices for a long time cannot be guaranteed without regular maintenance, something that is practically non-existent with water toilets.

Consequently, there is a need on the market for an improved, versatile flushing device for one or more adjustable flushing water amounts, with a simple construction, high reliability and a long service life, which comes as a separate, self-contained unit that can be manufactured at low cost, and at the same time can either easily replace a complete, existing flushing device with its discharge float and valve, or be installed during production of new water toilets.

There is also a need on the market for an improved flushing device for economy and full flushing, which can be easily adjusted regarding the water amount for economy flushing in most types and models of existing or new-manufactured water toilets, the function of which in practical operation is secure and consequent, especially with regard to the water amount for economy flushing, independently of any changes in the full reservoir water level that might occur due e.g. to contamination of the valve or a deteriorated float function in the reservoir replenishing device. The flushing device must further be such as not to require large forces or excessive movement in order to achieve the wanted flushing.

SUMMARY OF THE INVENTION

In accordance with the present invention, these and other objects have now been realized by the discovery of a method for flushing a toilet with at least one predetermined amount of water, the toilet having a flushing initiator, a water-containing reservoir, and a reservoir discharge valve for emptying the water-containing reservoir in response to the flushing initiator, the method comprising actuating the flushing initiator to therefore open the reservoir discharge valve, closing the reservoir discharge valve after a predetermined period of time, and determining the predetermined period of time by means of a hydraulic timer disposed in the water-containing reservoir whereby the water remaining in the water-containing reservoir operates the hydraulic timer. Preferably, the hydraulic timer includes a float chamber connected to the water-containing reservoir by means of a restricted outlet having a predetermined outlet area, whereby the float chamber and the water-containing reservoir normally have corresponding water levels, the method including determining the predetermined period of time by connecting the flushing initiator to the reservoir discharge valve for opening the reservoir discharge valve and thereby permitting the water in the float chamber to flow into the water-containing reservoir through the restricted outlet while the water in the water-containing reservoir flows through the reservoir discharge valve, thereby lowering the water level in the water-containing reservoir below the water level in the float chamber, and releasing the connection between the flushing initiator and the reservoir discharge valve to close the reservoir discharge valve after the difference between the water level in the water-containing reservoir and the water level in the float chamber reaches a predetermined difference.

In accordance with one embodiment of the method of the present invention, the at least one predetermined amount of water comprises at least first and second predetermined amounts of water corresponding to at least first and second predetermined periods of time, the first predetermined amount of water comprising a full flushing amount substantially corresponding to the water content of the water-containing reservoir and the second predetermined amount of water comprising an economy flushing amount substantially corresponding to about one-half of the water contents of the water-containing reservoir. In a preferred embodiment, the flushing initiator comprises a first flushing initiator and including a second flushing initiator, the first flushing initiator corresponding to the first predetermined amount of water and the second flushing initiator corresponding to the second predetermined amount of water.

In accordance with a preferred embodiment of the method of the present invention, the method includes continuously actuating the first flushing initiator to retain the reservoir discharge valve open for a predetermined period of time between the first and second predetermined periods of time.

In accordance with another embodiment of the method of the present invention, the full flushing amount corresponds to less than the full water content of the water-containing reservoir, the method including continuously actuating the second flushing initiator to retain the reservoir discharge valve open for a third predetermined period of time corresponding to the entire content of the water-containing reservoir.

In accordance with the present invention, apparatus has also been discovered for flushing a toilet including a water-containing reservoir with at least one predetermined amount of water, the apparatus comprising a reservoir discharge valve for emptying the water-containing reservoir, a flushing initiator for opening the reservoir discharge valve for a predetermined period of time, and a hydraulic timer disposed in the water-containing reservoir, the hydraulic timer determining the predetermined period of time based on the water remaining in the water-containing reservoir. In a preferred embodiment, the hydraulic timer comprises a float chamber, a float disposed in the float chamber for vertical movement therein, the float chamber including a restricted outlet opening having a predetermined outlet area in fluid communication with the water-containing reservoir, whereby the float chamber and the water-containing reservoir normally have corresponding water levels, connecting means for connecting the flushing initiator to the float for opening the reservoir discharge valve and permitting the water in the float chamber to flow into the water-containing reservoir through the restricted outlet while the water in the water-containing reservoir flows through the reservoir discharge valve, and trigger means for releasing the connection means when the float has moved a predetermined distance in the float chamber, whereby the predetermined period of time is determined by the predetermined area of the restricted outlet opening, and the reservoir discharge valve is closed directly upon release of the connection means.

In accordance with one embodiment of the apparatus of the present invention, the apparatus includes outlet opening adjustment means for adjusting the predetermined area of the restricted outlet opening. In a preferred embodiment, the flushing initiator comprises a first flushing initiator and including a second flushing initiator, wherein the at least one predetermined amount of water comprises first and second predetermined amounts of water, the first predetermined amount of water comprising a full flushing amount substantially corresponding to the water content of the water-containing reservoir and the second predetermined amount of water comprising an economy flushing amount corresponding to about one-half of the water content of the water-containing reservoir.

In order to demonstrate the versatility of the flushing device according to the present invention, it will be described below for two flushing water amounts; economy and full flushing, but it might just as well be produced for one flushing water amount only, whereby one flushing button mechanism would be eliminated.

BRIEF DESCRIPTION OF THE DRAWINGS

The invention will be described in more detail in the following detailed description which, in turn, refers to the accompanying drawings, of which.

Figure 2:
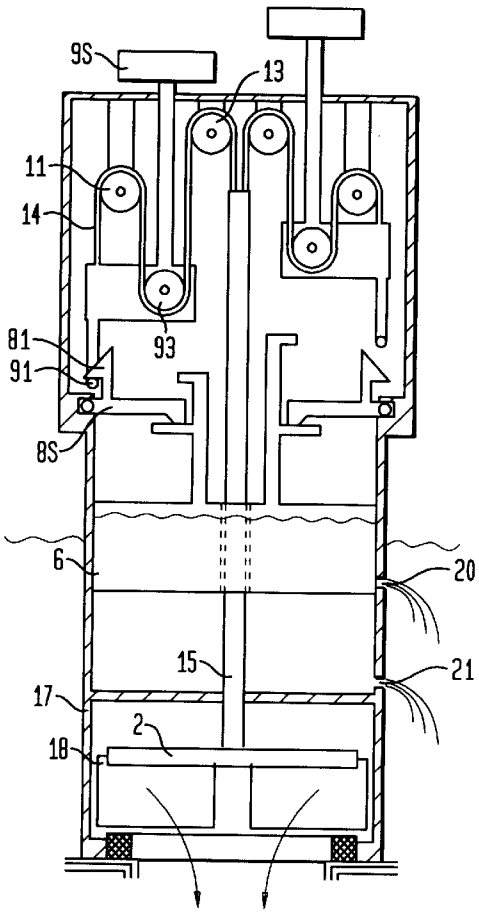
FIG. 2 is a side, elevational, partially sectional view corresponding to that of FIG. 1, but with the flushing button 9S for economy flushing depressed and connected in the depressed position, such that the discharge valve 2 has opened and the water levels in the flushing reservoir, as well as inside the float chamber 5 of the flushing device, has started to descend.

Referring to the drawings, in which like reference numerals refer to like elements thereof, mountings and guides for the flushing device in relation to the flushing reservoir may be designed in a multitude of different, known ways, and have been omitted from the figures for reasons of clarity, as they do not influence the principles of the present invention. Usually, the flushing device is placed on the bottom of the flushing reservoir, encircling the outlet hole thereof, and is clamped, by some suitable, known, longitudinally adjustable mounting device against the upper edge of the reservoir. The flushing device according to the present invention is, in its preferred embodiments, provided with such a known, vertically adjustable clamping device.

As is mentioned above, according to known techniques, economy flushing was often achieved by an auxiliary weight, balanced by an auxiliary float and descending in time with the water level in the flushing reservoir, thereby creating, below a certain water level, an additional gravity force on the float-equipped discharge valve through a driver lever, causing the valve to close faster than normal. By the normal alternative of full flushing, the auxiliary weight and float are not actuated at all, but the flushing process will then be the initial one, i.e. full flushing. This type of known device may consequently described as level or float operated, that is, controlled by the water level in the flushing reservoir.

The above cited devices according to U.S. Pat. Nos. 4,392,260 and 5,819,330 may then again be described, respectively, as electrically and mechanically timer controlled flushing devices.

In the device according to the present invention, however, there are no float-controlled auxiliary weights that make a float-equipped discharge valve close more rapidly than normal.

The discharge valve of the present invention has no float. Nor is it the water level in the flushing reservoir itself that determines when to close the discharge valve. The time of closing is, with the present invention, instead determined by one or more pre-adjustable periods of time between the point in time when an operating device for the flushing is actuated and the point in time when the flushing valve is closed, such as previously known, as mentioned above, from U.S. Pat. Nos. 4,392,260 and 5,819,330. In the device according to the present invention, however, there are no electrical components, nor any mechanical clockwork performing said timer function. Instead, the timer function is fully hydraulic, using water supplied from the flushing reservoir for its function.

The closing time is, in the illustrated embodiment of the present invention, determined by a float, enclosed in a separate chamber of the flushing device, and two triggering studs, and two locking arms, triggering the closing of the discharge valve at different water levels inside this separate float chamber, depending upon which locking arm/triggering stud combination is in operation. The selection of which locking arm is to be operational is performed by selection of the flushing button depressed by the user. The time required for the water level inside the float chamber to drop to the respective triggering point for closing the discharge valve is primarily determined by two discharge openings between the float chamber and the flushing reservoir. How quickly the water flows out of the float chamber depends primarily on the area of these openings, as the water level in the flushing reservoir has dropped below the float chamber level. The area of the discharge openings is thus made variable.

The float device in the illustrated embodiment of the flushing device according to the invention thus functions like a hydraulic, adjustable timer device, by which two triggering delay time periods for the closing of the reservoir discharge or flushing valve (for economy and full flushing, respectively) can be separately pre-set.

Secondarily, the discharge velocity from the float chamber under the conditions discussed above are also influenced by the water level difference between the float chamber and the flushing reservoir, but this influence is of a lesser order and can easily be compensated for during the adjustment.

The flushing device according to the present invention has a discharge valve that does not need to be held floating by the water in the flushing reservoir, as it is hitched mechanically in the open position. Therefore, it is not provided with any float function, entailing a secure closing against its seal, also entirely without flushing water in the reservoir. On the contrary, discharge valves according to the art often require a residual water volume in the flushing reservoir in order to close securely. This means, when fitting the flushing device according to the present invention into existing flushing reservoirs, there is an advantage in that the full flushing water amount in many cases could be increased, if required. When utilising the flushing device according to the present invention for new designs of water toilets, this entails the total reservoir volume being, in many cases, reduced by the same actual full flushing water amount, allowing corresponding savings in size, weight and cost.

Figure 1:
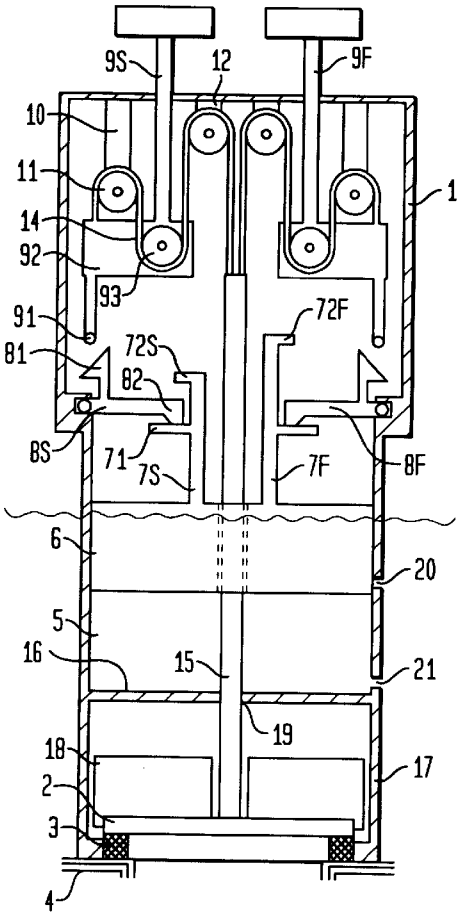
FIG. 1 is a side, elevational, partially sectional view of a flushing device according to the present invention, with the components in their initial positions and the flushing reservoir water level at the full level determined by the float-controlled inlet valve (not shown)

FIG. 1 shows all components in their initial positions, with the reservoir filled to its normal level with flushing water. The economy and full flushing device according to the illustrated embodiment of the present invention consists of a substantially cylindrical housing 1, having a bottom 16, located some distance above the bottom surface 4 of the flushing reservoir. The housing 1 and its bottom 16 define a cylindrical chamber 5, in which a substantially cylindrical float 6 is free to move axially, in time with the water level inside the float chamber. The float is however, in the illustrated embodiment, in a suitable known manner (not shown) locked against rotation relative to the housing 1. The float 6 is also provided with a central bore, allowing the pull rod 15 of the reservoir flushing valve 2 for discharge of the flushing water to run freely through the float. The pull rod 15 thereby also passes through a hole 19 in the bottom 16.In this manner, the clearance between the exterior diameter of the pull rod 15 and the diameter of the hole 19 is in practice only large enough to allow the pull rod to run without chafing inside the hole, whereas the water amount allowed to flow out in this manner from the float chamber 5 is negligible compared to that of the discharge openings 20 and 21, the function of which will be described further below.

Below the bottom 16 of the float chamber 5, the housing 1 is extended by the cylindrical portion 17, the lower edge of which, in the illustrated embodiment, is provided with a seal 3, sealing against the reservoir bottom 4, as well as against the discharge valve 2. The walls of the cylindrical portion 17 are latticed by apertures 18, through which flushing water may flow freely into the discharge valve 2.

On the top side of the float 6 there are two, diametrically opposed uprights, 7S and 7F, which are both provided with a lifting head 71 and each have a triggering stud, 72S and 72F, respectively, located at different heights. Aligned with the two uprights, 7S and 7F, there is each one locking arm, 8S and 8F, respectively, hinged for vertical turning in the locally thickened wall of the housing 1. The identically shaped inner ends 82 of the locking arms can be lifted by the respective lifting heads 71 of the uprights, and be forced downwards by the triggering studs, 72S and 72F, respectively, located at different vertical distances from the float, as the float 6 rises and drops, respectively, as a function of the water level inside the float chamber 5. The two discharge openings, 20 and 21, from the float chamber 5 are located as follows: The opening 20 lies substantially at that level to which the water surface inside the float chamber has dropped when the triggering stud 72S depresses the inner end 82 of the possibly hitched-up locking arm 8S and releases the locking hook 81 from the horizontal leg 91 of the L-shaped arm on the pushbutton 9S. The opening 21 is, on the other hand, located at the bottom of the float chamber 5, i.e. so as to allow all the water in the float chamber to flow out and let the float reach the level where the triggering stud 72F depresses the inner end 82 of the possibly hitched-up locking arm 8F and releases the locking hook 81 from the horizontal leg 91 of the L-shaped arm on the pushbutton 9F. This will be described in greater detail below.

The economy and full flushing device is also provided with two pushbuttons, 9S and 9F. These pushbuttons are both supported in the housing 1 by through holes in the topside of the housing 1, so as to be vertically movable, and by each one flexible band 14 running over band guide castors, 11 and 13, respectively, supported on brackets, 10 and 12, suspended from the top end of the housing 1, and running under a band guide castor 93, supported by a bearing in the portions 92 of the pushbuttons, 9S and 9F, respectively. The bands 14 are, at one of their respective ends, affixed to the discharge valve pull rod 15, and at their other respective ends fastened to the portions 92 of the respective pushbutton, as can be seen in FIG. 1. Both pushbuttons are identically shaped, but mirror-inverted, and each provided with one L-shaped arm extending downwards from the portions 92, the lower end of the arm being provided with a horizontal leg 91 that can cooperate with and be hitched-up on the locking hook 81 of the respective locking arm, 8S or 8F, when the appropriate pushbutton, 9S or 9F, is depressed, and the water level in the flushing reservoir, and inside the float chamber, is at its highest level and the float 6 is floating in the position shown in FIG. 1.

The bands 14 are of identical length and their fixation to the pull rod 15 is in a known manner (e.g. through a pin running in an oblong groove) designed to be single-acting (not shown in detail), such that each band 14 can act in a pulling manner on the pull rod 15, but that the pull rod cannot (e.g. due to the stiffness of the band) act in a pushing manner on one band 14, when pulled upwards by the other band 14. (As an alternative, the bands may be replaced by soft cords, allowing only pulling forces, whereby their fixation to the pull rod can be made completely fixed). The bands are also supported on the guide castors in such a way that they cannot slide off the castors when being slackened. This is, however, no part of the present invention and, for reasons of clarity, is not shown in these schematic illustrations. Due to the design with three castors, 11, 93 and 13, a gear ratio of 1:3 is achieved between the downwards movement of the pushbuttons and the lifting movement of the discharge valve 2.

The function of the economy and full flushing device according to the present invention is as follows, for economy flushing:

Initially, the reservoir water level is as shown in FIG. 1. The float chamber 5 has the same water level, as it communicates with the flushing reservoir by means of the openings, 20 and 21. This water level is so adjusted, by means of the inlet float and its associated valve, that the float 6 keeps both locking arms, 8S and 8F, approximately horizontal, under the influence of the lifting heads 71. The pushbutton 9S for economy flushing is depressed fully, whereby the situation according to FIG. 2 occurs. The horizontal leg 91 of the L-shaped arm on the pushbutton 9S pushes the locking hook 81 on the locking arm 8S aside, against the resistance of the float 6, and passes down below the locking hook, whereupon the locking hook 81 is immediately pushed back up by the float and hitches up the horizontal leg 91, and thereby the pushbutton 9S, in its lower end position. Simultaneously, the discharge valve 2 is lifted by the band 14 running by means of the guide castors, 11, 93 and 13, through the pull rod 15, and flushing water flows into the discharge valve 2 through the apertures 18 in the lower portion 17 of the housing 1 and on out through the discharge valve.

Figure 3:
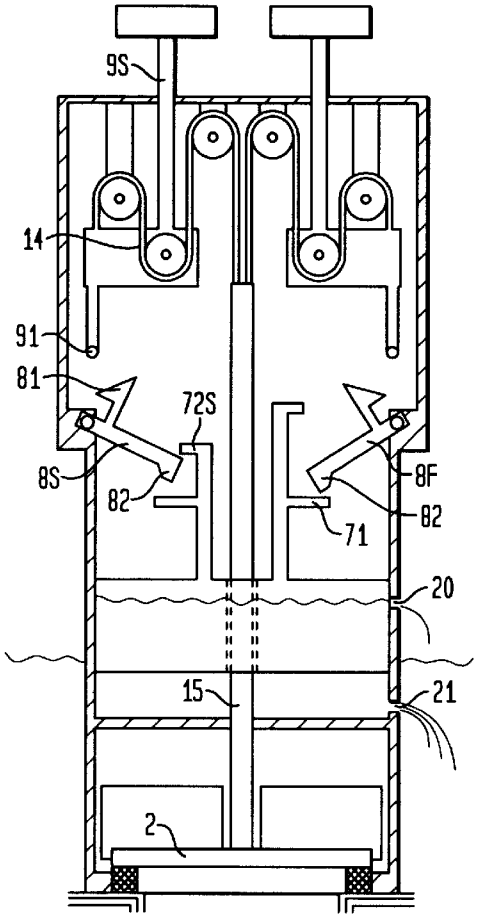
FIG. 3 is a side, elevational, partially sectional view corresponding to that of FIG. 1, but with the hitching device of the flushing device released by the integrated float 6 and the triggering stud 72S of the device, thereby causing the discharge valve 2 to close after having discharged a small amount of water (economy flushing)

The water lever in the flushing reservoir now begins to drop. As the float chamber 5 is in connection with the flushing reservoir through the adjustable area openings 20 and 21, the level inside the float chamber also starts to drop, lowering the float 6. However, the level inside the float chamber will drop slower than that of the flushing reservoir. How quickly the float chamber level will drop during the economy flushing phase, will depend on the pre-adjusted total restriction area of the openings, 20 and 21, as both openings will be below the water surface inside the float chamber 5. When the water surface in the float chamber has dropped to a predetermined level, the triggering stud 72S will contact the inner end 82 of the locking arm 8S, and start pressing it downwards as the float continues to drop. This movement of the locking arm 8S causes the locking hook 81 to start to move inwards, and will eventually unhitch from the horizontal leg 91, whereupon the pushbutton 9S is released and the discharge valve 2 will close quickly, due to its own weight and the Bernoulli forces from the out-flowing flushing water. As the discharge valve closes, the button 9S is pulled upwards to its initial position, through the pull rod 15 and the band 14. The state according to FIG. 3 has now been reached, and an economy flushing has been completed. It should be understood that the locking arm 8F in this case has not been hitched-up, but has followed the float downwards, resting with its inner end 82 on the lifting head 71. The restriction areas of the openings, 20 and 21, have, during the initial tuning, thus usually been set in such a way that about half of the water content of the flushing reservoir has been used up, but other volume values are equally conceivable.

After completion of an economy flushing, the flushing reservoir water level begins to rise again. When the water level has reached its pre-set full level, controlled by the inlet float, everything will be reset to the initial position according to FIG. 1.

Figure 4:
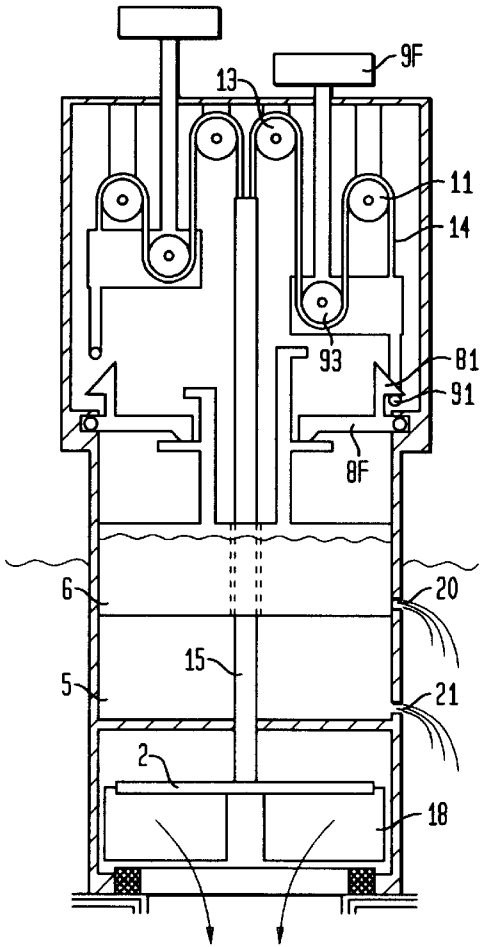
FIG. 4 is a side, elevational, partially sectional view corresponding to that of FIG. 2, but with the flushing button 9F for full flushing depressed and hitched in the depressed position, such that the discharge valve 2 has opened and the water levels in the flushing reservoir, as well as inside the float chamber 5 of the flushing device, has started to descend.
Figure 5:
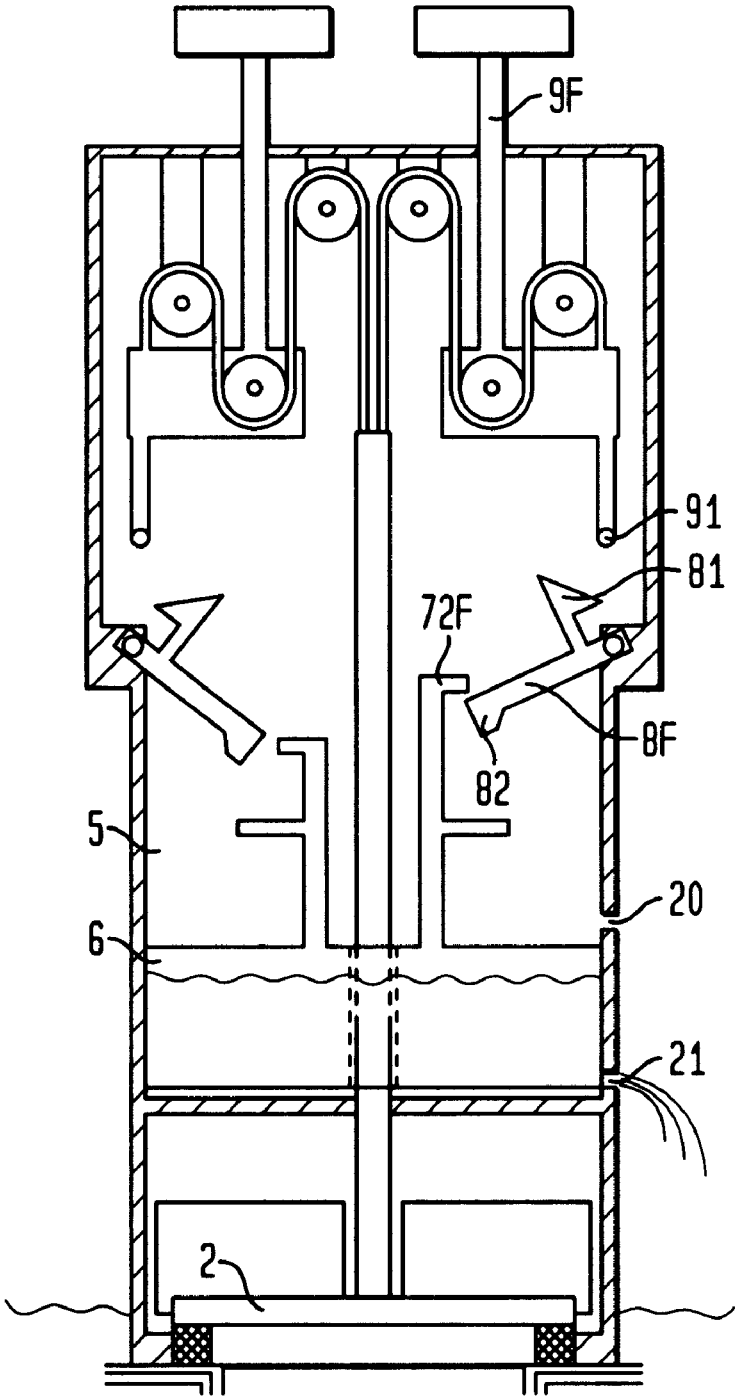
FIG. 5 is a side, elevational, partially sectional view corresponding to that of FIG. 3, but with the hitching device of the flushing device released by the integrated float 6 and the triggering stud 72F of the device, thereby causing the discharge valve 2 to close after having completed a full flushing (normally a substantially completely drained reservoir)

For full flushing, the full flushing pushbutton 9F is instead depressed completely, causing the situation according to FIG. 4 to occur. The horizontal leg 91 of the L-shaped arm on the pushbutton 9F pushes the locking hook 81 on the locking arm 8F aside, against the resistance of the float 6, and passes down below the locking hook, whereupon the locking hook 81 is immediately pushed back up by the float and hitches up the horizontal leg 91, and in this manner to the pushbutton 9F, in its lower end position. As the triggering stud 72F is located at a greater vertical distance from the topside of the float 6, the water level in the float chamber has to drop to a lower level before the locking arm 8F is depressed and the locking hook 81 releases the horizontal leg 91 of the L-shaped arm on the full flushing button 9F and allows the discharge valve 2 to close. More precisely, this will occur just before the float 6 reaches the bottom of the float chamber 5, and this position is shown in FIG. 5. At the beginning of the flushing process, water will discharge from the float chamber through both openings 20 and 21, just as during economy flushing. When the level in the float chamber (and of course the flushing reservoir) has dropped below the closing level for economy flushing, the opening 20 will lie above the water surface inside the float chamber 5. Hence, discharge of water from the float chamber will only occur through the lower discharge opening 21, which thus determines the total period of time until the flushing/discharge valve 2 closes during full flushing. (See FIG. 5). Otherwise, the function is the same as was described above for economy flushing.

Figure 6:
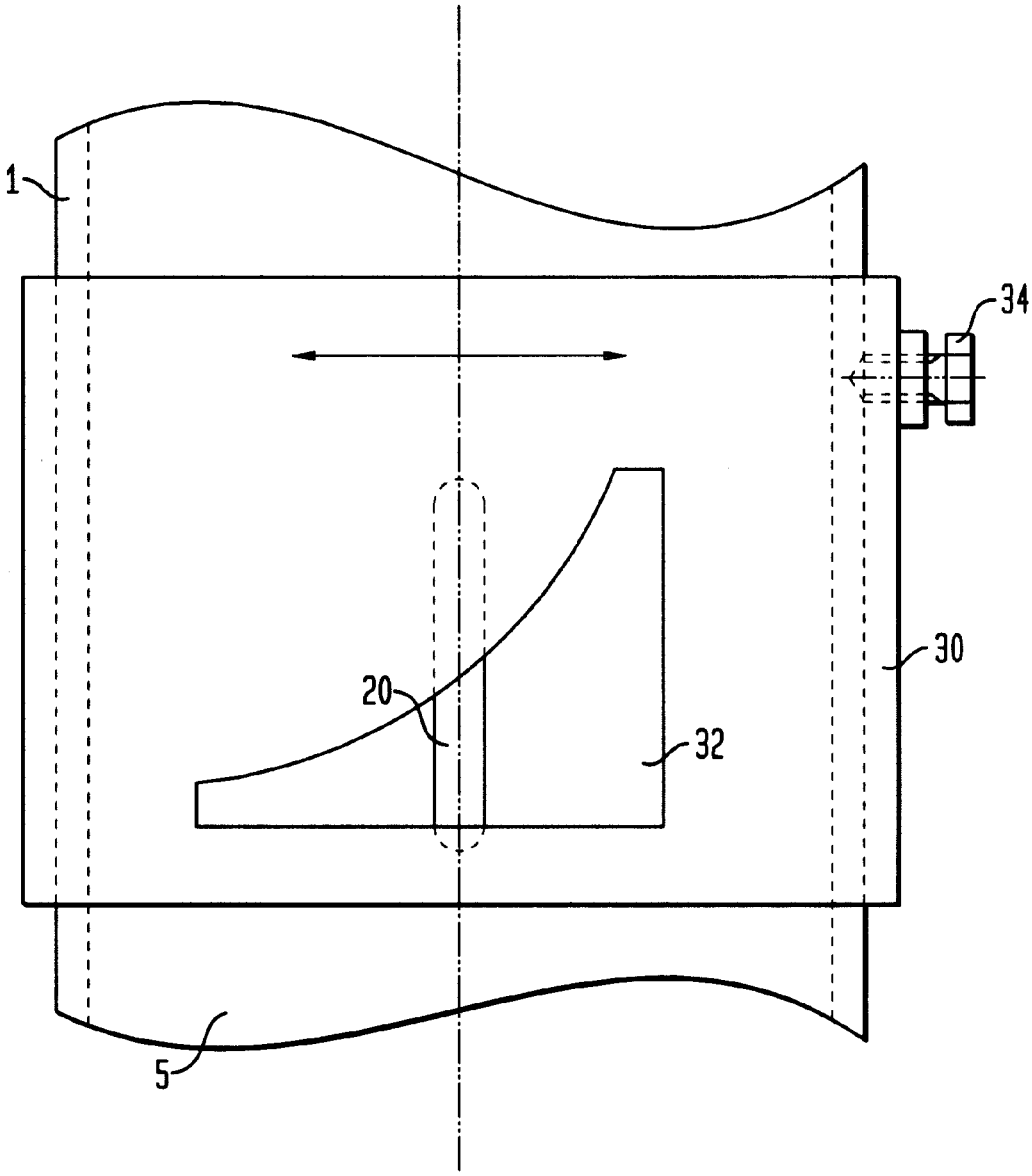
FIG. 6 is a side, elevational, enlarged schematic view of a portion of the housing 1 and the sleeve 30, with the aperture 32 at the opening 20 thereof.

The amount of water discharged during economy and full flushing may be pre-set for various needs and different toilet models by providing the economy/full flushing device according to the present invention with known arrangements for adjusting the areas of the discharge openings, 20 and 21. For reasons of clarity, this has not been illustrated in FIGS. 1–5, but the openings there seem to have a fixed area. By the preferred embodiment, however, the discharge openings for economy as well as full flushing have in practice been manufactured like vertical, elongated slots, 20 and 21, in the external wall of the float chamber/housing 1. Two cylindrical sleeves are then rotatably and lockably arranged around the outside of the float chamber, one at each opening, 20 and 21, and with a tight fit onto the housing 1. A profile-shaped, substantially triangular aperture 32 is arranged in each sleeve in such a manner that a rotation of the exterior sleeve 30 in relation to the wall of the float chamber/housing 1 will free a larger or smaller area of the vertical slots, through which the float chamber is drained to the flushing reservoir. (See FIG. 6, illustrating a schematic and enlarged view of a portion of the housing 1 and the sleeve 30 with the aperture 32 at the opening 20). Rotation for area adjustment may thus be performed as indicated by the arrows in the figure. The locking device is only suggested at 34, but may be of any known type. A corresponding arrangement is thus present also at opening 21. In this manner, the testing and adjusting of a suitable timer setting for economy as well as full flushing, during fitting of the cartridge according to the present invention into an arbitrary flushing reservoir, will be quite easy, and the rotational position of the two sleeves are then locked with e.g. a locking screw 34. In this manner, a basic setting of the area of the opening 21 is initially performed, in order to determine a sufficient period of time for full flushing before the discharge valve 2 will close, and then a fine tuning of the area of the opening 20 is performed, in order to set a suitable closing time for the discharge valve 2 for economy flushing.

The economy flushing amount is usually adjusted, as was stated before, to about half of the water volume of the flushing reservoir, whereas the full flushing amount is likewise normally adjusted to empty the flushing reservoir to at least the same lowest level as was achieved before, with the previously installed, normally single-flushing float/valve assembly, i.e. substantially total discharge of, or only with a very small residual water volume, determined by the design of the flushing reservoir and the previously installed flushing device.

The device according to the present invention thus provides, thanks to its function of setting the flushing time, rather than the level in the flushing reservoir, at which the discharge valve 2 is to close, a secure and consequent economy flushing being achieved, always with the same amount of water, even if the reservoir water level for any reason has changed from its set position or was set to be excessively high or low from the beginning.

Moreover, there is a further possibility with the economy/full flushing device according to the present invention. The "conscious flusher" may use the economy flushing button 9S also after completed larger needs, but hold the button depressed until he/she observes that all the waste has just disappeared, and then release it. The discharge valve 2 will then close quickly, and the discharged amount of water will then be exactly as large as necessary, and will lie between the economy flushing amount and the full flushing amount.

The same device according to the present invention can also be adjusted for three different, pre-set flushing water amounts, by changing the timer setting for what is above referred to as "full flushing" to a shorter time, such that a "full flushing" will not empty the flushing reservoir completely, but to a position between the above-mentioned economy flushing and full flushing. A third flushing water amount, that is a complete draining of the reservoir, could then be provided by the user holding the pushbutton 9F depressed until the flushing reservoir is completely drained, rather than, as in the normal case, releasing it after a short period of time and in this last case then obtaining an "intermediate flushing".

As was mentioned above, the flushing device according to the present invention can be produced for one flushing water amount only, with otherwise the same properties as described above.

Also, the flushing device according to the present invention may also be produced without adjustment possibilities for the areas of the openings, 20 and 21, for an economy and full flushing version, and of the only opening for a single-flushing version, respectively, if the manufacture of a special model for a large series of identical water toilets was required.

The seal 3 of the embodiment described may also be replaced by a separate seal between the lower portion 17 of the housing and the bottom of the reservoir and a separate seal for the discharge valve 2.

The bands 14 used in the described embodiment could, as was mentioned above, also be replaced by cords, for example of spun/braided nylon or the like.

Activation of the operating device(-s) could of course just as well be made as a lifting motion as a depressing motion.

The materials could be selected from a wide range of non-corroding metals, as well as synthetic resins and rubber compounds having the appropriate strength.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of flushing a toilet with at least one predetermined amount of water, said toilet having a flushing initiator, a water-containing reservoir, and a reservoir discharge valve for discharging water from said water-containing reservoir in response to said flushing initiator, said method comprising:

actuating said flushing initiator to open said reservoir discharge valve, thereby initiating discharge of the water from said water-containing reservoir, and to hold open said reservoir discharge valve, releasing and closing said reservoir discharge valve solely after a predetermined period of time thereby terminating the discharge of the water from said water-containing reservoir, and determining said predetermined period of time by a hydraulic timer that is disposed in said water-containing reservoir and which uses the water stored in said water-containing reservoir as its operating medium.

2. The method of claim 1 wherein said hydraulic timer includes a float chamber connected to said water-containing reservoir via a restricted outlet having a predetermined outlet area whereby said float chamber and said water-containing reservoir have corresponding water levels before said flushing initiator is actuated, said method including determining said predetermined period of time by connecting said flushing initiator to said reservoir discharge valve to open said reservoir discharge valve and to hold open said reservoir discharge valve so that said water in said water-containing reservoir is permitted to discharge freely through said open reservoir discharge valve which lowers said water level in said water-containing reservoir below that of said float chamber and enables said water in said float chamber to flow through said restricted outlet into said water-containing reservoir thereby lowering said water level in said float chamber, and releasing said reservoir discharge valve to close said reservoir discharge valve after said water level in said float chamber has fallen a predetermined distance.

3. The method of claim 2 wherein said predetermined period of time is further determined by adjusting an area of said restricted outlet thereby controlling a time from when said water in said float chamber begins to flow through said restricted outlet into said water-containing reservoir until said water level in said float chamber has fallen said predetermined distance.

4. The method of claim 2 wherein said at least one predetermined amount of water comprises at least first and second predetermined amounts of water corresponding to at least first and second predetermined periods of time, said first predetermined amount of water comprising a full flushing amount substantially corresponding to the water content of said water-containing reservoir and said second predetermined amount of water comprising an economy flushing amount substantially corresponding to about one-half of said water contents of said water-containing reservoir.

5. The method of claim 4 wherein said flushing initiator comprises a first flushing initiator and including a second flushing initiator, said first flushing initiator corresponding to said first predetermined amount of water and said second flushing initiator corresponding to said second predetermined amount of water.

6. The method of claim 5 including continuously actuating said first flushing initiator to manually hold said reservoir discharge valve open for a third period of time that is less than said first predetermined period of time and greater than said second predetermined period of time.

7. The method of claim 5 wherein said full flushing amount corresponds to less than the full water content of said water-containing reservoir, said method including continuously actuating said second flushing initiator to manually retain said reservoir discharge valve open for a third period of time that is greater than said first predetermined period of time to discharge the entire content of said water-containing reservoir.

8. A method of flushing a toilet with at least one predetermined amount of water, said toilet having a flushing initiator, a water-containing reservoir, and a reservoir discharge valve for emptying said water-containing reservoir in response to said flushing initiator, said method comprising actuating said flushing initiator to therefore open said reservoir discharge valve, closing said reservoir discharge valve after a predetermined period of time, and determining said predetermined period of time by means of a hydraulic timer disposed in said water-containing reservoir whereby the water remaining in said water-containing reservoir operates said hydraulic timer, wherein said hydraulic timer includes a float chamber connected to said water-containing reservoir by means of restricted outlet having a predetermined outlet area, whereby said float chamber and said water-containing reservoir normally have corresponding water levels, said method including determining said predetermined period of time by connecting said flushing initiator to said reservoir discharge valve for opening said reservoir discharge valve and thereby permitting said water in said float chamber to flow into said water-containing reservoir through said restricted outlet while said water in said water-containing reservoir flows through said reservoir discharge valve, thereby lowering said water level in said water-containing reservoir below said water level in said float chamber, and releasing said connection between said flushing initiator and said reservoir discharge valve to close said reservoir discharge valve after the difference between said water level in said water-containing reservoir and said water level in said float chamber reaches a predetermined difference.

9. The method of claim 8 wherein said at least one predetermined amount of water comprises at least first and second predetermined amounts of water corresponding to at least first and second predetermined periods of time, said first predetermined amount of water comprising a full flushing amount substantially corresponding to the water content of said water-containing reservoir and said second predetermined amount of water comprising an economy flushing amount substantially corresponding to about one-half of said water contents of said water-containing reservoir.

10. The method of claim 9 wherein said flushing initiator comprises a first flushing initiator and including a second flushing initiator, said first flushing initiator corresponding to said first predetermined amount of water and said second flushing initiator corresponding to said second predetermined amount of water.

11. The method of claim 10 including continuously actuating said first flushing initiator to retain said reservoir discharge valve open for a predetermined period of time between said first and second predetermined periods of time.

12. The method of claim 10 wherein said full flushing amount corresponds to less than the full water content of said water-containing reservoir, said method including continuously actuating said second flushing initiator to retain said reservoir discharge valve open for a third predetermined period of time corresponding to the entire content of said water-containing reservoir.

13. An apparatus for flushing a toilet including a water-containing reservoir with at least one predetermined amount of water, said apparatus comprising:

a reservoir discharge valve for discharging water from said water-containing reservoir, a flushing initiator for opening said reservoir discharge valve, thereby initiating discharge of the water from said water-containing reservoir, and for holding open said reservoir discharge valve only for a predetermined period of time, and a hydraulic timer disposed in said water-containing reservoir, said hydraulic timer determining said predetermined period of time using the water stored in said water-containing reservoir as its operating medium, said predetermined period of time for determining a releasing and closing said reservoir discharge valve thereby terminating the discharge of the water from said water-containing reservoir.

14. The apparatus of claim 13 wherein said hydraulic timer comprises a float chamber, a float disposed in said float chamber for vertical movement therein, said float chamber including a restricted outlet opening having a predetermined outlet area in fluid communication with said water-containing reservoir whereby said float chamber and said water-containing reservoir have corresponding water levels before said flushing initiator is actuated, connecting means for connecting said flushing initiator to said float to open said reservoir discharge valve and to hold open said reservoir discharge valve so that said water in said water-containing reservoir is permitted to discharge freely through said open reservoir discharge valve which lowers said water level in water-containing reservoir below that of said float chamber and enables said water in said float chamber to flow through said restricted outlet into said water-containing reservoir thereby lowering said water level in said float chamber, and trigger means disposed on said float for releasing said reservoir discharge valve to close said reservoir discharge valve after said water level in said float chamber has fallen a predetermined distance, said float having moved said predetermined distance during said predetermined period of time, whereby said predetermined period of time is determined by said predetermined area of said restricted outlet opening and by a volume of water in said float chamber that corresponds to said water level in said float chamber having fallen said predetermined distance.

15. The apparatus of claim 14 including outlet opening adjustment means for adjusting said predetermined area of said restricted outlet opening.

16. The apparatus of claim 15 wherein said flushing initiator comprises a first flushing initiator and including a second flushing initiator, and wherein said at least one predetermined amount of water comprises first and second predetermined amounts of water, said first predetermined amount of water comprising a full flushing amount substantially corresponding to the water content of said water-containing reservoir and said second predetermined amount of water comprising an economy flushing amount corresponding to about one-half of the water content of said water-containing reservoir.

17. An apparatus for flushing a toilet including a water-containing reservoir with at least one predetermined amount of water, said apparatus comprising a reservoir discharge valve for emptying said water-containing reservoir, a flushing initiator for opening said reservoir discharge valve for a predetermined period of time, and a hydraulic timer disposed in said water-containing reservoir, said hydraulic timer determining said predetermined period of time based on the water remaining in said water-containing reservoir, wherein said hydraulic timer comprises a float chamber, a float disposed in said float chamber for vertical movement therein, said float chamber including a restricted outlet opening having a predetermined outlet area in fluid com munication with said water-containing reservoir, whereby said float chamber and said water-containing reservoir normally have corresponding water levels, connecting means for connecting said flushing initiator to said float for opening said reservoir discharge valve and permitting said water in said float chamber to flow into said water-containing reservoir through said restricted outlet while said water in said water-containing reservoir flows through said reservoir discharge valve, and trigger means for releasing said connection means when said float has moved a predetermined distance in said float chamber, whereby said predetermined period of time is determined by said predetermined area of said restricted outlet opening, and said reservoir discharge valve is closed directly upon release of said connection means.

18. The apparatus of claim 17 including outlet opening adjustment means for adjusting said predetermined area of said restricted outlet opening.

19. The apparatus of claim 18 wherein said flushing initiator comprises a first flushing initiator and including a second flushing initiator, and wherein said at least one predetermined amount of water comprises first and second predetermined amounts of water, said first predetermined amount of water comprising a full flushing amount substantially corresponding to the water content of said water-containing reservoir and said second predetermined amount of water comprising an economy flushing amount corresponding to about one-half of the water content of said water-containing reservoir.

* * * * *